US005811721A

United States Patent [19]

Andersson et al.

[11] Patent Number: 5,811,721

[45] Date of Patent: Sep. 22, 1998

[54] AMMUNITION FEEDER

[75] Inventors: Par Andersson, Linghem; Sten Hallqvist, Vingaker, both of Sweden

[73] Assignee: Bofors AB, Karlskoga, Sweden

[21] Appl. No.: 809,819

[22] PCT Filed: Oct. 13, 1995

[86] PCT No.: PCT/SE95/01181

§ 371 Date: Jun. 2, 1997

§ 102(e) Date: Jun. 2, 1997

[87] PCT Pub. No.: WO96/12152

PCT Pub. Date: Apr. 25, 1996

[30] Foreign Application Priority Data

Oct. 13, 1994 [SE] Sweden ..... 9403469

[51] Int. Cl.[6] ..... F41A 9/00

[52] U.S. Cl. ..... 89/45; 89/47; 89/33.01

[58] Field of Search ..... 89/45, 46, 47, 89/33.01, 33.05, 33.1

[56] References Cited

U.S. PATENT DOCUMENTS 3,884,119 5/1975 Zouck ..... 89/45
3,988,962 11/1976 Elwin ..... 89/47
4,481,862 11/1984 Wiethoff et al. .
4,991,489 2/1991 Lindberg ..... 89/45
5,440,966 8/1995 Tellander et al. ..... 89/47

*Primary Examiner*—Charles T. Jordan
*Assistant Examiner*—Theresa M. Wesson
*Attorney, Agent, or Firm*—Pollock, Vande Sande & Priddy

[57] ABSTRACT

A method and apparatus for automatically transferring a vertically standing ammunition component from a delivery opening in a carriage mounted magazine to a flick rammer incorporated in a gun elevation system is provided. In the method, a loading pendulum is positioned immediately outside the delivery opening of the magazine and parallel to the ammunition component. The ammunition component is then ejected from the magazine onto the loading pendulum without changing the vertical orientation of the ammunition component. The ammunition component is then locked in the loading pendulum and the loading pendulum is raised about a first axle to a substantially horizontal position. An outer cradle, in which the loading pendulum is suspended, is then lowered about a second axle coinciding with the trunnion center of the gun to an angle which coincides with the elevation of the gun and to a position above the flick rammer such that the ammunition component is immediate above the flick rammer. The ammunition component is then unlocked and transferred from the loading pendulum into the flick rammer.

6 Claims, 4 Drawing Sheets

Fig. 4
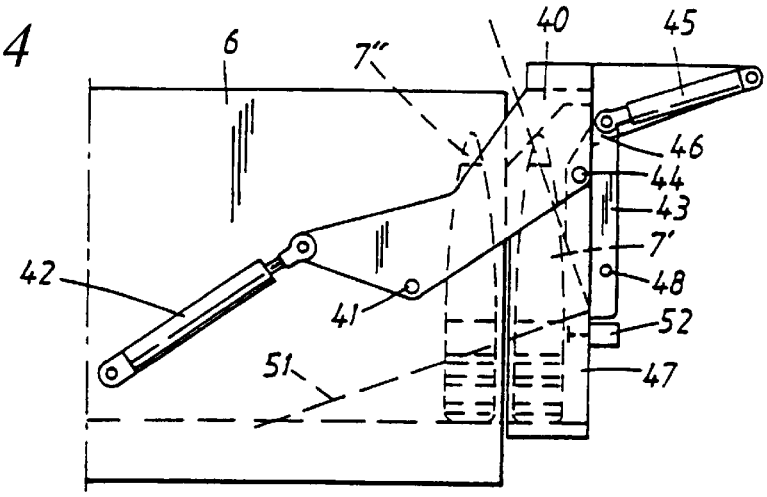
Fig. 5
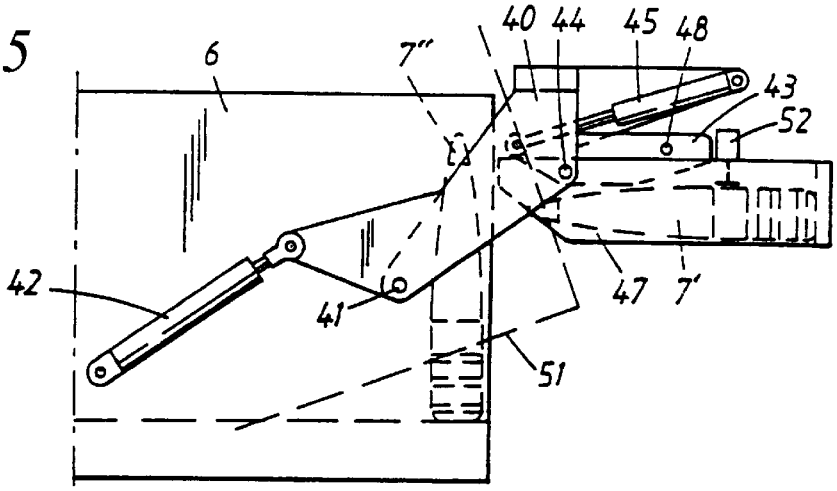
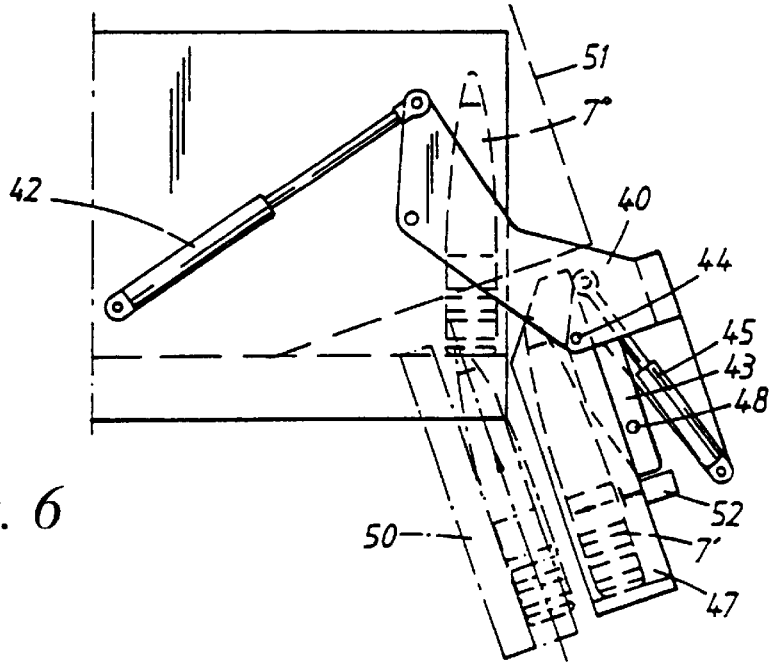
Fig. 6

AMMUNITION FEEDER

FIELD OF THE INVENTION

The present invention relates to a method and a device used, in automatically loaded artillery guns provided with carriage-mounted shell and/or propellant magazine for transferring principally shells, but also, in an appropriately modified form, propellant charges, from a freely selectable compartment in the magazine to a rammer which is incorporated in the elevation system of the gun or which is connected to the elevation system in terms of movement.

BACKGROUND OF THE INVENTION

Modern artillery tactics require extremely high loading speeds, even for heavier guns, and at the same time entail the need for rapid changes in the gun elevation and in the size of the propellant charges between the different shots in a salvo. This is, of course, done in an attempt to get as many shells as possible to hit the target area as close upon each other as possible, and this is achieved by firing the various shells in one salvo towards the target area along trajectories of different heights. In addition, the increased maximum firing ranges of the guns mean that there is an ever greater number of different propellant charges to alternate between. The most flexible type of propellant charge presently available includes a variable number of charge modules with combustible and essentially stiff outer casings. These charge modules are found in at least two basic types. One type is designed so that the various modules can be connected to larger or smaller charges, but not even these connected charge modules have the same stability as a unit charge of an older type. Charges made up of these type charge modules are therefore more difficult to ram automatically than the completely stiff unit charges with metal, plastic or combustible casings. In the alternative cases where the charge modules in accordance with the above are not connected to each other, the difficulties increase to a corresponding extent.

A major problem for today's gun constructors has been to develop a novel loading system which is sufficiently fast to satisfy modern artillery techniques and which at the same time is sufficiently flexible so that it is possible to use the abovementioned module charges and benefit from all the advantages thereof. Another problem has then been to develop an effective system for automatic loading of the gun with a freely selectable shell taken from a magazine which is preferably carriage-mounted, i.e. from a magazine which is at all times accessible on the gun but which, because it does not follow the elevation of the gun, means that when the shells are being fed for ramming, it is necessary to bridge a plurality of angle positions and movements in different planes. Trials with gun-mounted shell magazines which follow the gun elevation have shown that although the automatic loading system is then considerably simpler, the magazine capacity has to be limited, for weight reasons, to far too great an extent, and it becomes difficult to fit the magazine with new shells and propellant charges.

What is expected to be a main component in the general loading system of the future has already been available for some years now, namely the so-called flick rammer with which it is possible to effect a rapid ramming of larger shells at high elevations. As the name suggests, the flick rammer is designed to throw shells and/or propellant charges at high speed into the ramming device in the gun. However, the flick rammer is mainly used today for shells and completely stiff unit charges, for example, the type with combustible casings or discardable casings made of plastic or metal. On the other hand, it has been difficult to get the flick rammer to function satisfactorily with module charges of the abovementioned types. Also, flick rammers, if they are to function without error, depend on an extremely precise alignment in relation to the gun barrel. However, artillery systems in the future will probably not be equipped with only flick rammers, but also with other rammers.

The present invention relates to a method and a device for the handling of ammunition components, such as shells and propellant charges, until they are ready for ramming in the loading trough of a rammer. The invention also includes the design of the carriage-mounted shell magazine which, by virtue of its design, allows the use of a large number of shells which can, in addition, be of several different types and can be selected freely with regard to the type of target in the particular case in question.

The premises of the method and the device according to the invention are therefore; that the magazine shall be able to contain a large number of shells, which means that the magazine, if it is to be a fixed part of the gun, must be mounted on the carriage; that the magazine shall contain several different types of shells which shall all be available for use at all time; and, that the ramming of the shells in the gun barrel shall be effected with a rammer which is incorporated in the elevation system of the gun, since this is the surest way to guarantee a correct alignment at all times between the rammer and gun barrel. This alignment is an absolute requirement if the ramming is to be correct and is to function without error even at high elevations.

These premises mean that when the ammunition components are being moved from the magazine to the rammer, several different angle positions have to be bridged and the shells and propellant charges have to be moved in several different planes and directions.

According to one embodiment of the invention, as far as the shell magazine is concerned, the problem of constant access to shells of different types has been solved by the magazine being designed with the same number of longitudinal feed paths as there are different types of shell, and the shells are fed along these paths step by step, standing on their rear end. The shells are thus advanced in a controlled manner so that, provided the respective feed path has not been completely emptied, there will always be a shell of each type available in the delivery opening of the magazine.

The basic principle of the method and the device according to the invention is in other respects that a first or outer cradle, which is journalled about a straight line which passes through the gun trunnion center, is responsible for feeding a shell or the like, which is suspended in a loading pendulum, from an essentially horizontal zero angle position to an angled position which corresponds to the elevation of the gun. An inner cradle is pivotably mounted in this outer cradle, and the loading pendulum is suspended in the inner cradle. The inner cradle, which can constitute a part of the loading pendulum, is responsible for the latter's movement from a position immediately outside the delivery opening of the magazine to the zero angle position. For transferring a shell, for example, to the loading pendulum, the feed function of the magazine is simply used, which function, when it is activated, pushes a new shell forwards to the outlet of the delivery opening, and the shell which was previously standing in this position is simply pushed over into the loading pendulum. In the embodiment in which the magazine has several feed paths, the loading pendulum is made such that it can be displaced sideways in the inner cradle, or together with the latter, as a result of which it is possible to set the loading pendulum in front of the shell which has been selected for use. This sideways displacement function can also be used so that the loading pendulum, in the final stage of its movement, will reach a laterally offset flick rammer to which it will transfer the shell by positioning itself directly over the flick rammer and opening the locking function and, at least at high elevations or when the feeder is used for propellant charges, activating an ejector which actively displaces the object from the loading pendulum and over to the rammer.

The invention will now be described in somewhat greater detail with reference to the accompanying figures, in which:

BRIEF DESCRIPTION OF THE DRAWINGS

FIGS. 4–6 show diagrammatically, on a larger scale, how the shells are moved in every respect other than their sideways displacement.

DETAILED DESCRIPTION OF THE PREFERRED EMBODIMENT(S)

Figure 1:
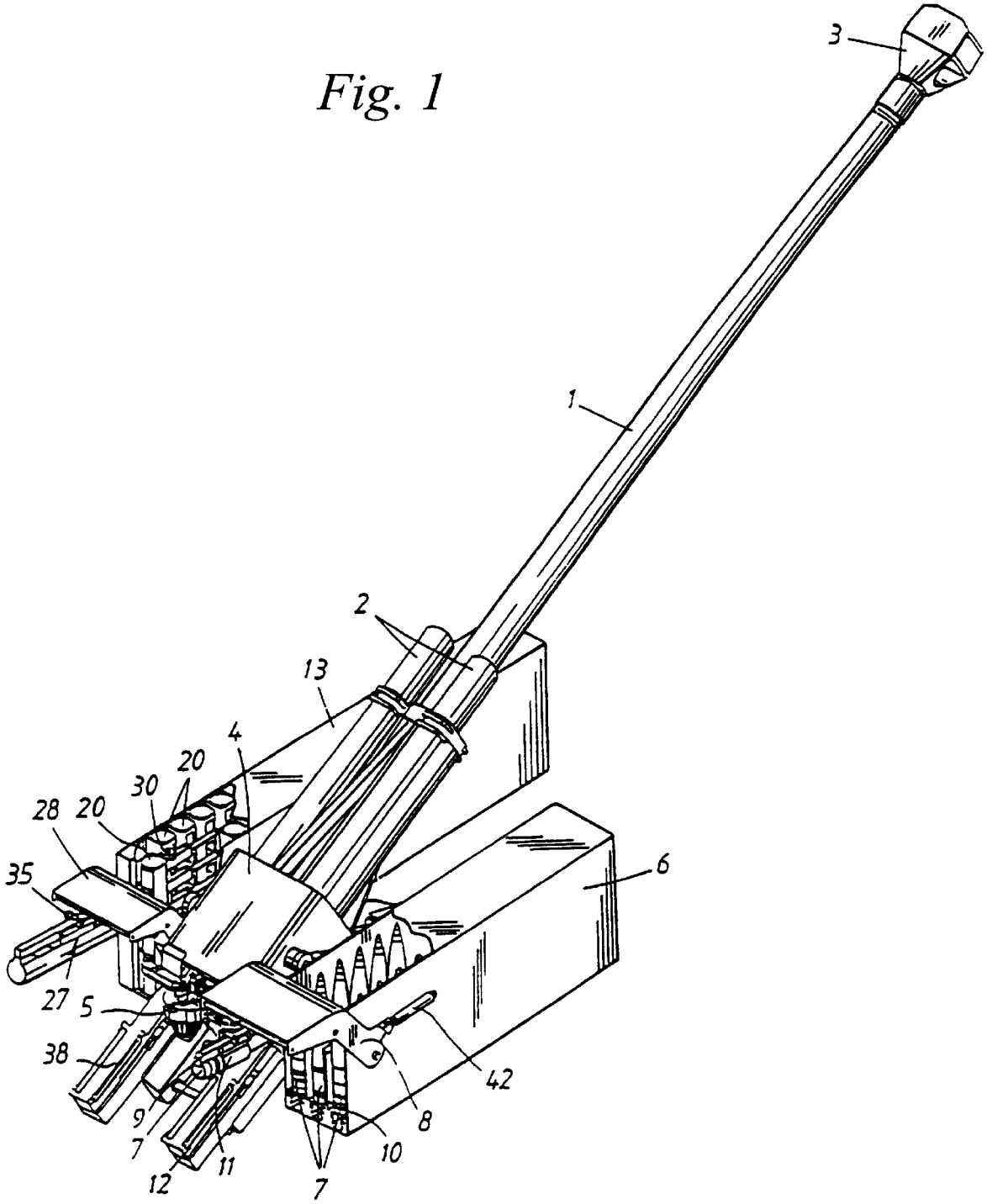
FIG. 1 shows an oblique projection, in partial cross-section, of an artillery gun designed in accordance with the present invention, but with the undercarriage having been omitted for the sake of clarity.

The artillery gun shown in FIG. 1 includes the barrel 1 with recoil buffers and recuperator 2, muzzle brake 3, gun cradle 4 and a conventional screw mechanism 5 which is shown in the open position in the figure. The figure also shows some of the components which are important for the functioning of the assembled gun, such as the shell magazine 6 which, in the example shown in the figure, holds shells 7 of three different types which are arranged in three different rows and can be fed out individually. The number of rows of shells can be varied within the limits of the maximum allowable width of the complete gun. There is a pivotable cradle 8 arranged on the shell magazine 6. In the cradle 8, a shell pendulum 9 is suspended pivotably and displaceably on the axle 9*a*. The shell pendulum 9 can be pivoted in from the position shown in the figure, where it lies essentially horizontally, to a vertical position immediately adjacent to the delivery end 10 of the magazine 6. By the sideways displacement function, which can be based, for example, on the axle 9*a* which supports the shell pendulum 9 being in the form of a threaded rod which is driven by a motor adapted thereto, while the bearing of the shell pendulum 9 for this rod is a freely rotating nut 9*b*, or vice versa, the shell pendulum can additionally be placed directly in front of the shell with which the gun is to loaded. With the aid of the grabs 11 which form part of the shell pendulum 9 and are indicated in the figure, the pendulum takes hold of the shell in question when the latter has been pushed, by an ejector function built into the magazine, onto the base plate 9*c* of the pendulum. After this, the pendulum is transferred, by a hydraulic piston or other adjusting means 9*d* fitted between the pendulum and an axle 8*a*, to the horizontal position shown in FIG. 1. The shell pendulum is thereafter moved sideways to a position in line with and above the rammer 12, whereupon the shell pendulum cradle 8 (which is journalled in the gun trunnion center) swings with the shell pendulum to a position which corresponds to the gun elevation, after which the shell can be transferred directly to the rammer 12, which also follows the gun elevation, and from which the shell is rammed once the rammer has been fully brought into alignment with the barrel 1.

Figure 2:
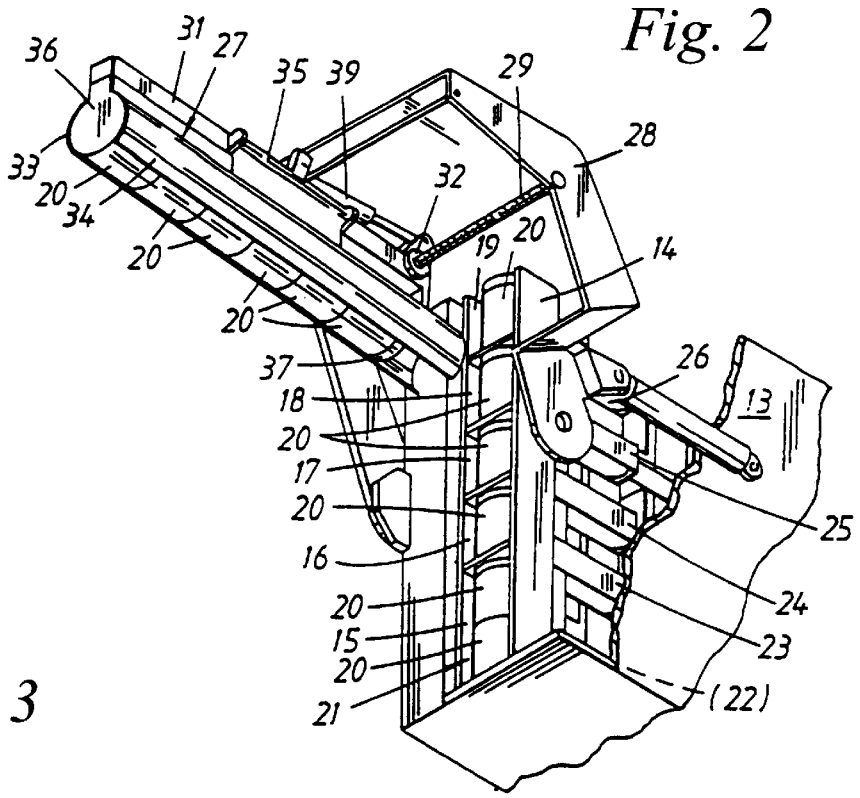
FIG. 2 shows, on a larger scale, an oblique projection, in partial cross-section, of the magazine from which the gun is supplied with propellant charges.

The propellant magazine 13 of the gun is also shown in FIG. 1, but it is mainly shown in FIG. 2. A mechanically displaceable endless chain conveyor runs in the propellant magazine 13, the chain conveyor consists of several vertical sets of compartments 14 which are hinged together to form a chain. In the figures, these are shown as chutes open on one side. Each one of these sets of compartments or chutes 14 includes a number of compartment 15–19 each initially holding one propellant module, or in the case of the compartment 15 two propellant modules, generally designated by 20 hereinafter. The number of propellant modules in each compartment can of course be varied between one and several, depending entirely on which gun is being used and on the size of the propellant modules. The sets of compartments 14 are fed successively by the endless chain conveyor to a vertical delivery opening 21 formed in the magazine 13. In this position, all the propellant modules 20 present in the various compartments of the set of compartments can be acted on by the ejectors 22–26 designed for this purpose. The ejector 22 is completely hidden in FIG. 2, while the ejector 26 is mostly hidden. The delivery opening 21 will be supplied, as and when necessary, with new sets of compartments which have all their compartments 15–19 filled with propellant modules. A number of propellant modules adapted for each firing will be displaced by the ejectors 22–26 onto to a loading pendulum 27 lowered alongside the delivery opening. The loading pendulum 27 has a first inherent lowering function 39 which is used for lowering the loading pendulum alongside the delivery opening 21, and a second lowering function in the form of the cradle 28 which is journalled in the gun trunnion center, in which it is secured and with which it can be lowered to an angle which is adapted to the gun elevation in order to lie, in the same manner as the shell, in an angled position adapted to its propellant charge rammer 38 for direct transfer of the propellant charge to the propellant charge rammer 38, which depends on the gun elevation for its angled position. The loading pendulum is also arranged in the cradle 28 such that it can be displaced sideways along a guide beam 29. Because of this its transverse position can be aligned in relation to the propellant charge rammer 38. The guide beam 29 can, as in the case of the shell pendulum, be a threaded axle which is rotated by a suitable drive member and both supports the loading pendulum and displaces it sideways. When the required number of propellant modules 20 have been transferred to the loading pendulum 27, the endless chain conveyor made up of the sets of compartments 14 is moved by driven cog wheels 30 being turned one step, and the propellant modules 20 which were not used in the previous set of compartments return to the system, while at the same time a full complement of propellant modules corresponding to the maximum loading of the gun are available at the delivery opening 21 for the next loading operation.

The transfer of the predetermined number of propellant modules 20 to the loading pendulum 27, by being ejected from their respective compartments 15–19 by the ejectors 22–26, is carried out with the loading pendulum 27 in the lowered vertical position alongside the delivery opening 21.

The loading pendulum is built around a main beam 31 which has a journal 32 for the guide beam 29 along which the loading pendulum can move sideways. It also has two long side walls 33, 34 which are adapted to the external form of the propellant modules 20 and which are hinge-journalled and can be opened by a common hydraulic piston 35 (see FIG. 1), and a fixed counter-support 36 which is arranged at the end of the loading pendulum and which points downwards when the latter is lowered against the delivery opening 21 of the magazine. Inside the loading pendulum there is a compacting heel 37, partly hidden in the figures, which is movable in its longitudinal direction from the end opposite the fixed counter-support 36 towards the latter.

The loading pendulum 27 functions such that when it is first lowered vertically against the delivery opening 21 and its long sides 33, 34 are opened to a sufficient extent to allow the propellant modules to be moved therein, the desired number of propellant modules 20 are transferred to the loading pendulum 27. As soon as this operation has been carried out, the hydraulic piston 35 is activated and the long sides 33, 34 of the loading pendulum are closed. During the final stage of this closing operation the various propellant modules are forced to form a straight column one directly above the other. The hydraulic piston is thereafter activated and maneuvers the compacting heel 37 so that it is displaced against and presses the various propellant modules 20 together. The loading pendulum is then raised and displaced sideways so that it lies in line with and above a rammer, shown in FIG. 1 in the form of a flick rammer 38. The loading pendulum cradle 28 (which is journalled in the gun trunnion center) swings together with the loading pendulum to a position corresponding to the gun elevation, with the loading pendulum immediately above the flick rammer. The propellant charge is then moved to the flick rammer by means of the long sides of the loading pendulum being opened, after which the propellant charge is pressed into the flick rammer by a member which is adapted for this purpose and which can be a hydraulic piston, an electrical adjusting member, a spring pretensioned at an earlier stage of the loading sequence, or another mechanical device.

The detailed construction of the two rammers 12 and 38 has nothing to do with the present invention, and for this reason they are not described in any detail. It will suffice to note that in their rest and filling position, which is shown in FIG. 1, they lie alongside the gun recoil, and that upon ramming they are moved sideways, one after the other, into line with the barrel, whereupon the shell and propellant charge are rammed. Because the rammers are journalled in a frame which forms part of the gun elevating system, only a lateral alignment of the rammers is required for the complete alignment to be correct.

Figure 3:
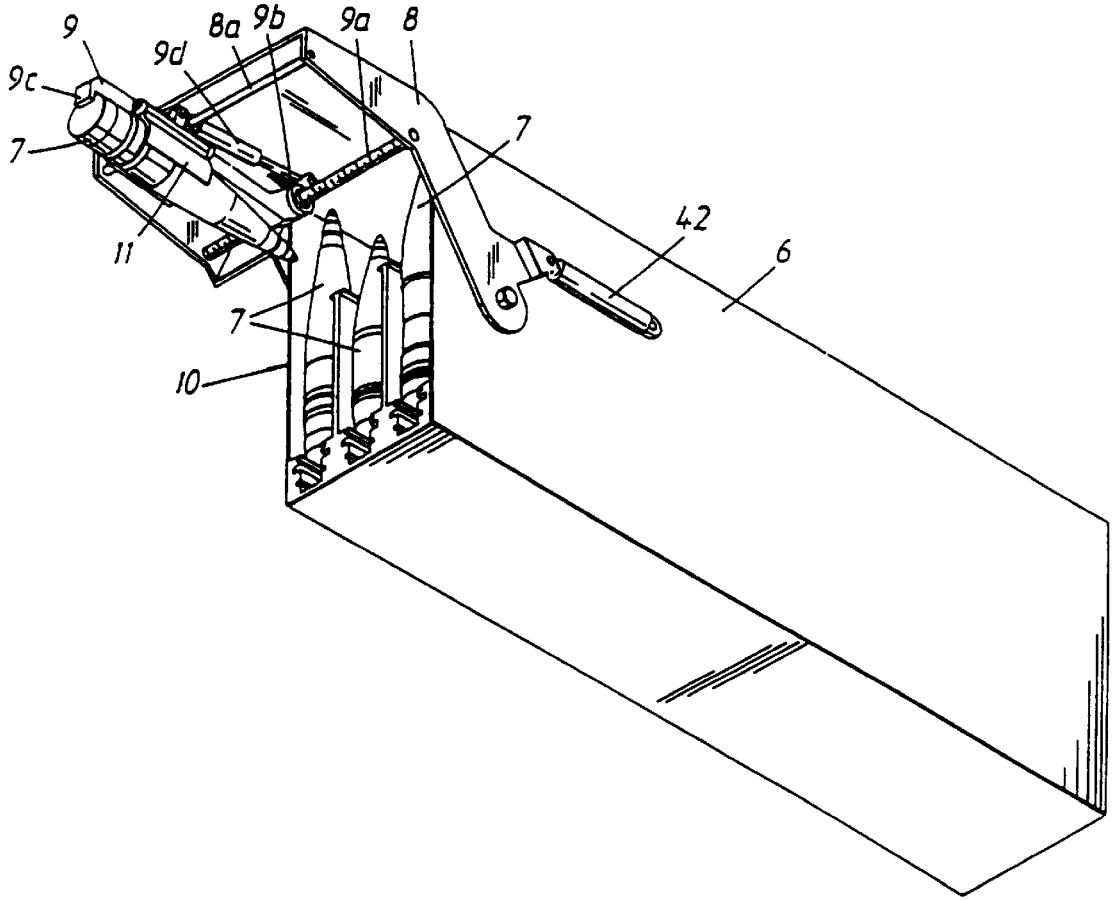
FIG. 3 shows, on a different scale, an oblique projection, in partial cross-section, of the shell magazine.
Figure 7:
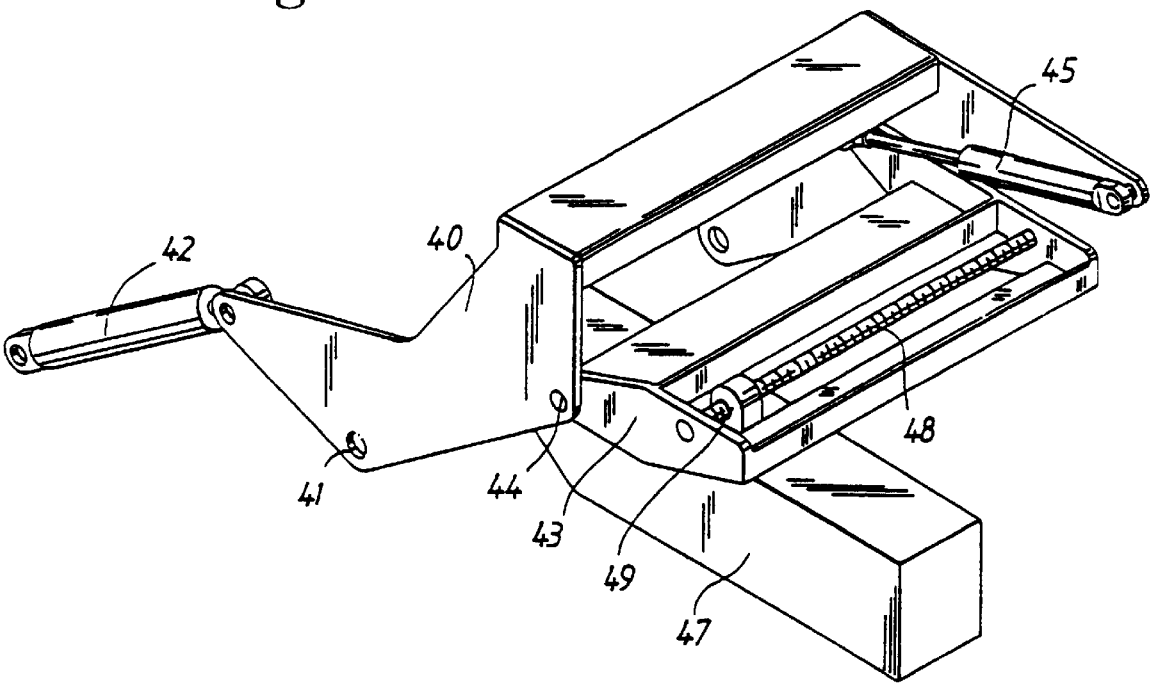
FIGS. 7 and 8 show details of some important parts in FIGS. 4–6, which parts are designed slightly differently than corresponding parts in FIGS. 1–3, even though the function is the same.
Figure 8:
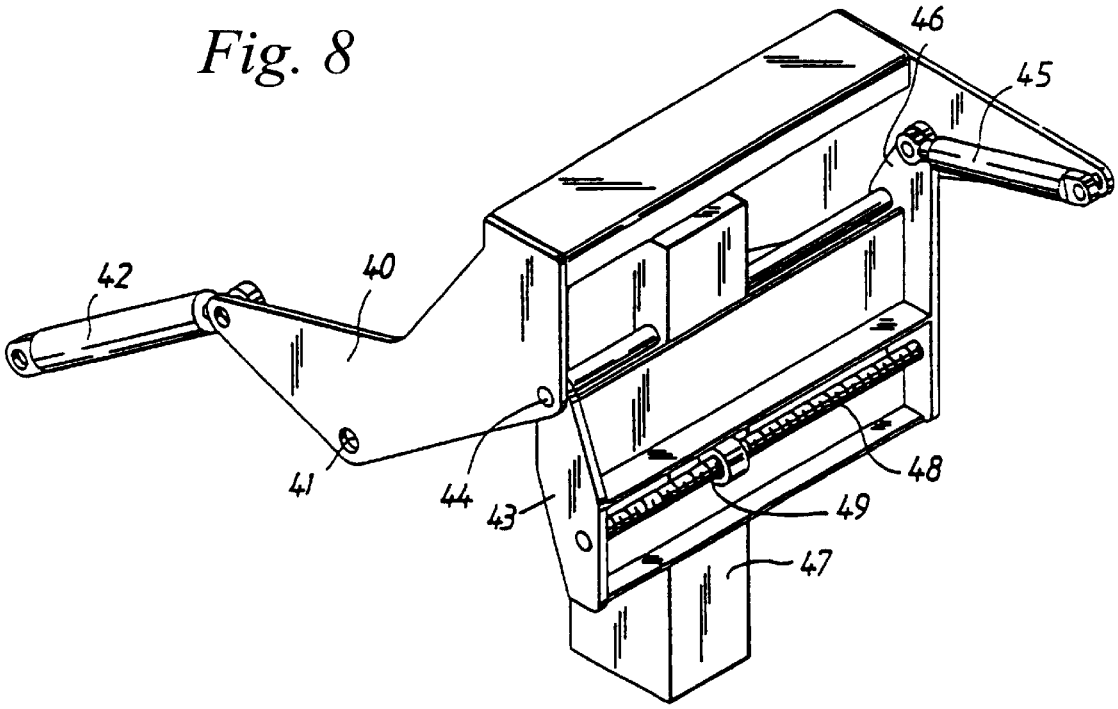

The movement sequence illustrated in FIGS. 4–6 involves the use of a somewhat different device from the one shown in FIGS. 1 and 3. The main parts of the device are shown in FIGS. 7 and 8. These include a first or outer cradle 40 which is journalled at the gun center trunnion at journal point 41. The movement of this outer cradle is identical to that of the cradle 8. For swinging the cradle between its different positions, there is a hydraulic piston 42 which can be the same piston as in FIGS. 1 and 3. An inner cradle 43 is pivotably mounted in this outer cradle about an axle 44 which is parallel to the journal points 41. The swinging movements of this inner cradle are controlled by a hydraulic piston or another suitable member 45 tensioned between a cam 46 on the inner cradle and the outer cradle. A shell pendulum 47 is suspended in a laterally displaceable manner in the inner cradle. Except for its slightly different suspension, the loading pendulum 47 is identical to the shell pendulum 9. The sideways displacement of the loading pendulum 47 is controlled, as in the case of the loading pendulum 9, by a threaded rod 48, which is driven by a hydraulic motor, electric motor or other member (not shown), and a free-running nut 49 at the connection point to the pendulum.

The entire shell-collecting sequence is shown in FIGS. 4–6. FIG. 4 shows the starting position in which the hydraulic piston 45 lowers the shell pendulum 47 in front of the delivery opening of the magazine 6 and a shell 7' has been pushed over into the pendulum, while the next shell 7" has moved into the next delivery position.

All these figures show the rear contours 51 of the artillery gun 1–5 elevated to 70°. Once the locking members (not shown in the figures) have been activated, the inner cradle is transferred with the shell pendulum and the shell by the hydraulic piston or equivalent 45 to the zero angle position shown in FIG. 5. At that point, or during the movement to that point, the hydraulic piston 42 is activated and the outer cradle 40 is lowered, with its contents of the inner cradle 43 and the shell pendulum 47, to the position shown in FIG. 6, in which the shell 7' lies immediately above an indicated rammer 50 to which the shell is pressed over by the member 52 as soon as the locking members of the pendulum are opened. If necessary, this function sequence may also have a sideways displacement in the manner previously described.

We claim:

1. A method for automatically transferring a vertically standing ammunition component from a delivery opening in a carriage mounted magazine to a flick rammer incorporated in a gun elevation system, said method comprising the steps of:

positioning a loading pendulum immediately outside said delivery opening and parallel to said ammunition component;

ejecting said ammunition component from said magazine onto said loading pendulum without changing the vertical orientation of said ammunition component;

locking said ammunition component in said loading pendulum;

raising said loading pendulum about a first axle to a substantially horizontal position;

lowering an outer cradle, journalled to said magazine about an second axle coinciding with the trunnion center of the gun and in which said first axle is journalled, to an angle which coincides with the elevation of the gun to a position above said flick rammer such that said ammunition component is immediately above said flick rammer;

unlocking said ammunition component from said loading pendulum; and transferring said ammunition component from said loading pendulum to said flick rammer.

2. The method of claim 1 wherein said magazine contains a plurality of shells arranged along side each other at said delivery opening and further comprising the step of moving said loading pendulum sideways to locate it directly in front of said shell selected for use.

3. An apparatus for transferring a vertically standing ammunition component from a carriage mounted magazine to a flick rammer incorporated in the elevation system of a gun, said apparatus comprising:

an outer cradle attached to said magazine via a first axle, said axle coinciding with a line through the trunnion center of said gun, said outer cradle movable between a first position which is substantially horizontal to a second angled position coinciding with the gun elevation;

a loading pendulum pivotally mounted in said outer cradle to a second axle, said second axle journalled in said outer cradle and parallel to said first axle, said loading pendulum movable between a vertical position in which said loading pendulum is arranged immediately outside a delivery opening of said magazine and parallel to said ammunition component located therein, and a second position parallel with respect to said first position of said outer cradle;

a base support plate attached to said loading pendulum;

means for moving said ammunition component from said magazine onto said base plate, said means for moving arranged in said magazine;

means for locking said ammunition component in said loading pendulum; and means for displacing said ammunition component from said loading pendulum to said flick rammer when said outer cradle is in said second position, wherein when said outer cradle and said loading pendulum are in their second positions, respectively, said ammunition component is positioned immediately above said flick rammer.

4. The apparatus of claim 3 wherein said magazine contains a plurality of shells arranged along side each other at said delivery opening and further comprising means for sideways displacement of said loading pendulum in said outer cradle whereby said loading pendulum can be placed in front of a shell which has been selected.

5. The apparatus of claim 4 wherein said magazine has a plurality of feed paths which are parallel to each other and which correspond to said plurality of shells, said feed paths being adapted to move said shells step by step when said loading pendulum has been moved from said first position.

6. The apparatus of claim 5 wherein said step by step advance of said shells is adapted to eject said shell from said magazine onto said loading pendulum.

* * * * *